US009397449B2

(12) United States Patent
Guo et al.

(10) Patent No.: US 9,397,449 B2
(45) Date of Patent: Jul. 19, 2016

(54) RECEPTACLE CONNECTOR FLEXIBLY CONNECTED TO A MOTHER BOARD

(71) Applicant: HON HAI PRECISION INDUSTRY CO., LTD., New Taipei (TW)

(72) Inventors: Jing-Jie Guo, Kunshan (CN); Wen-Zhang Lin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/464,724

(22) Filed: Aug. 21, 2014

(65) Prior Publication Data

US 2015/0056865 A1 Feb. 26, 2015

(30) Foreign Application Priority Data

Aug. 21, 2013 (CN) ..... 2013 2 0511403 U
Aug. 21, 2013 (CN) ..... 2013 2 0511711 U

(51) Int. Cl.
*H01R 24/00* (2011.01)
*H01R 13/66* (2006.01)
*H01R 13/6581* (2011.01)

(52) U.S. Cl.
CPC ..... *H01R 13/6658* (2013.01); *H01R 13/6581* (2013.01); *H01R 2201/06* (2013.01)

(58) Field of Classification Search
CPC ..... H01R 13/6658; H01R 13/6581; H01R 13/6666; H01R 13/6466; H01R 13/6469; H01R 2201/06
USPC ..... 439/660, 607.35
See application file for complete search history.

(56) References Cited

U.S. PATENT DOCUMENTS 6,135,790 A * 10/2000 Huang ..... H01R 13/41 439/607.01
6,582,252 B1 * 6/2003 Lin ..... H01R 12/725 439/160
7,422,488 B1 * 9/2008 Wu ..... H01R 13/6597 439/676
7,534,141 B1 * 5/2009 Wu ..... H01R 24/62 439/607.01
7,682,203 B1 * 3/2010 Pharney ..... H01R 13/6658 439/676
8,033,841 B2 * 10/2011 He ..... H01R 13/6473 439/108
8,668,524 B2 * 3/2014 Lan ..... H01R 12/724 439/607.35
2010/0136846 A1 * 6/2010 Pharney ..... H01R 13/6658 439/676
2012/0071021 A1 * 3/2012 Wu ..... H01R 13/502 439/449
2013/0040492 A1 * 2/2013 Wu ..... H01R 13/5808 439/607.55
2013/0045642 A1 * 2/2013 Wu ..... H01R 24/30 439/676
2013/0210273 A1 * 8/2013 Wu ..... H01R 13/652 439/607.34
2013/0244498 A1 * 9/2013 Zhang ..... H01R 13/41 439/676
2014/0004753 A1 * 1/2014 Tai ..... H01R 13/6461 439/676
2014/0113493 A1 * 4/2014 Funamura ..... H01R 12/716 439/626

FOREIGN PATENT DOCUMENTS

TW M400684 3/2011
TW M457323 7/2013

* cited by examiner

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A receptacle connector (100) includes an insluative housing (1), a number of contacts (2) retained in the insulative housing; a metal shield (4) covering the insulative housing for defining a space for receiving a plug connector along an insertion direction, and a cable (3) having a first end soldered to a mother board of an electronic appliance and a second end directly soldered with the soldering portions of the contacts in a first embodiment and indirectly connected with the contacts via a printed circuit board in a second embodiment.

15 Claims, 14 Drawing Sheets

RECEPTACLE CONNECTOR FLEXIBLY CONNECTED TO A MOTHER BOARD

BACKGROUND OF THE INVENTION

1. Field of the Invention

The present invention relates generally to a receptacle connector, and more particularly to a receptacle connector flexibly connected to a mother board.

2. Description of Related Arts

Taiwan Pat. No. M457323 issued to JU CHENG on 2013 Jul. 11 discloses a receptacle connector comprising an insulative housing, a plurality of contacts retained in the insulative housing, and a metal shield covering the insulative housing for defining a space for receiving a mating plug connector. The insulative housing has a base portion and a tongue portion extending forwardly from the insulative housing. The contacts have a plurality of contacting portions for connecting with the plug connector, a plurality of soldering portions for soldering on a mother board, and a plurality of connection portions connecting between the soldering portions and the contacting portions. Because the soldering portions are directly soldered on the mother board of an electronic appliance, connection between the receptacle connector and the mother board is fixed. Such layout of the contacts on the mother board does not meet miniaturization of an electronic appliance.

A receptacle connector flexibly connected to a mother board is desired.

SUMMARY OF THE INVENTION

Accordingly, an object of the present invention is to provide a receptacle connector flexibly connected to a mother board.

According to a preferred embodiment of the present invention, there is provided a receptacle connector that includes an insulative housing, a number of contacts retained in the insulative housing, and a metal shield covering the insulative housing to define therebetween a space for receiving a plug connector along an insertion direction. The insulative housing includes a base portion, a tongue portion extending forwardly from the base portion along the insertion direction, and a rear plate extending rearwardly from the base portion. Each contact has a contacting portion exposed in the tongue portion and a soldering portion retained by the rear plate and extending at an angle with respect to the contacting portion. The receptacle connector further includes a cable having a first end soldered to a mother board of an electronic appliance and a second end in line with and directly soldered with the soldering portions of the contacts on two opposite faces of the rear plate.

According to an alternative embodiment of the present invention, there is provided a receptacle connector that includes an insluative housing, a number of contacts retained in the insulative housing, and a printed circuit board attached to the insulative housing. The printed circuit board includes a number of first conductive pads connecting with the contacts and a number of second conductive pads in electrical connection with the number of first conductive pads. Each of the first conductive pads extends in a first direction and each of the second conductive pads extends in a second direction perpendicular to the first direction. The receptacle connector further includes a cable having a first end connected to a mother board of an electronic appliance and a second end electrically connected with the contacts via the printed circuit board so that the cable extends perpendicular to the contacts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
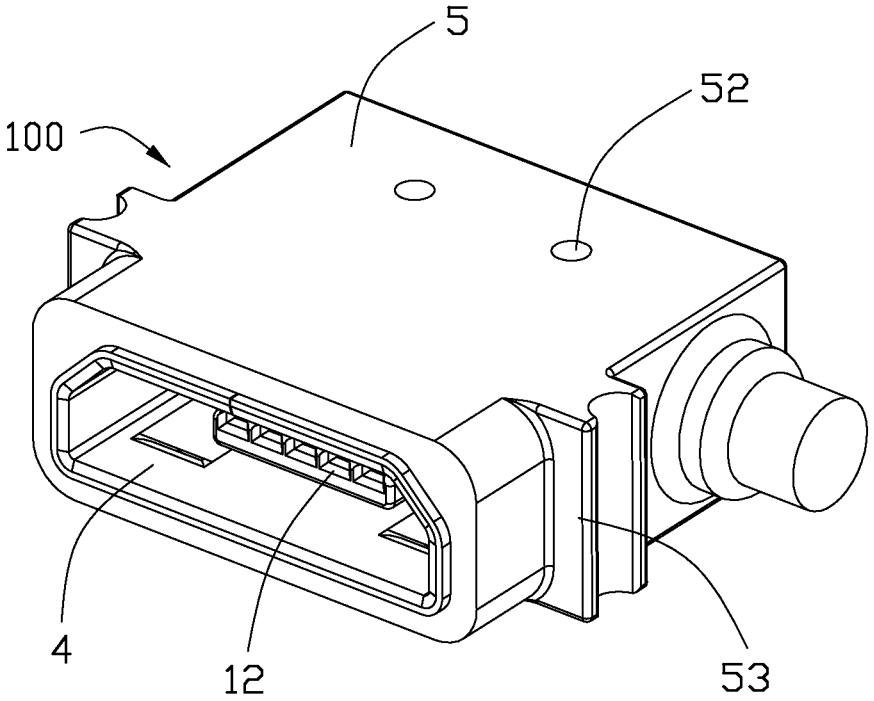
FIG. 1 is a perspective, assembled view of a receptacle connector in a first embodiment constructed in accordance with the present invention.
Figure 2:
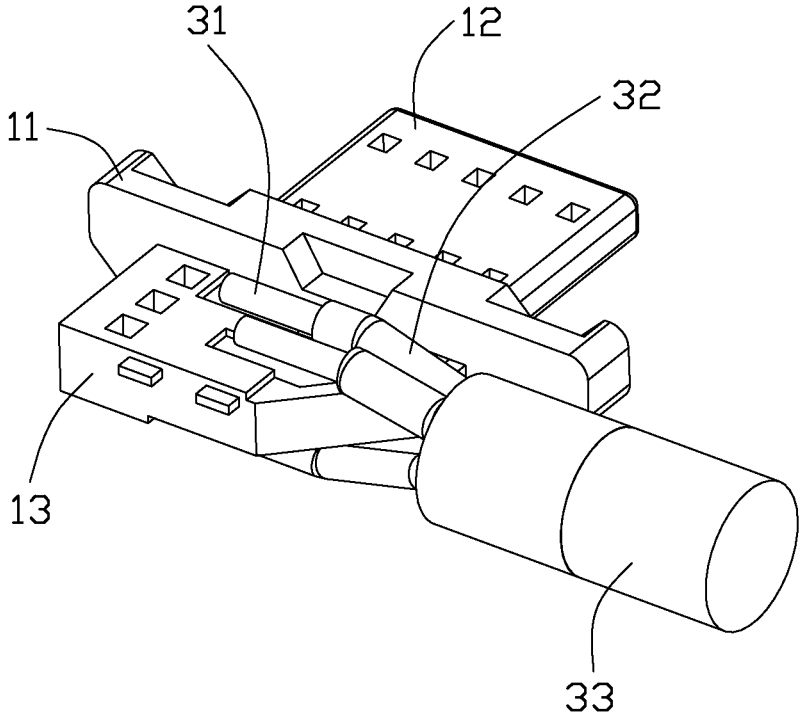
FIG. 2 is a perspective, partly assembled view of an insulative housing and a cable of the receptacle connector.
Figure 3:
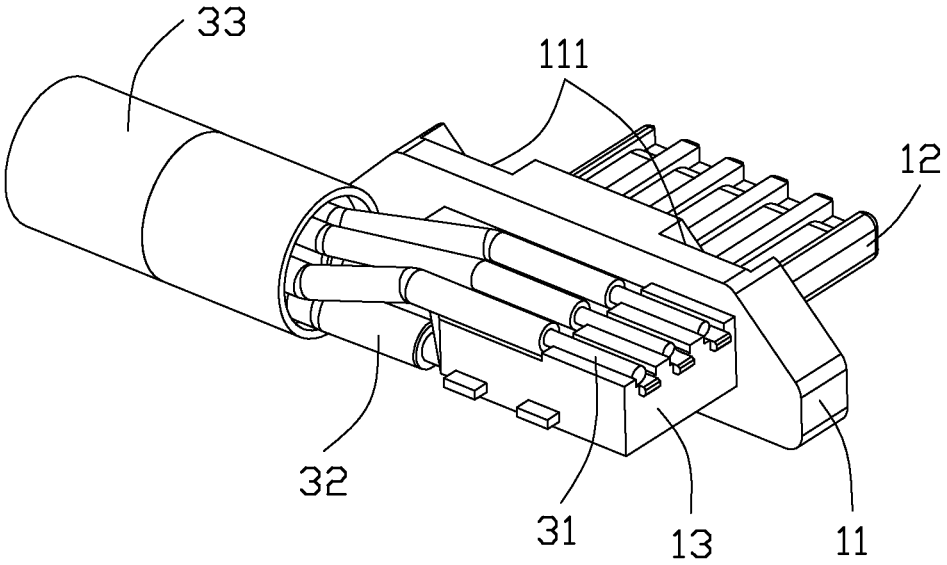
FIG. 3 is similar to FIG. 2, but taken from a different view.

Reference will now be made in detail to the preferred embodiment of the present invention.

Referring to FIGS. 1-7, a receptacle connector 100 in a first embodiment of the present invention used for receiving a mating plug connector (not shown) along an insertion direction, comprises an insulative housing 1, a plurality of contacts 2 retained in the insulative housing 1, a cable 3 connecting with the contacts 2, a metal shield 4 covering the insulative housing 1, and an insulative cover 5 molded over the metal shield 4.

Figure 6:
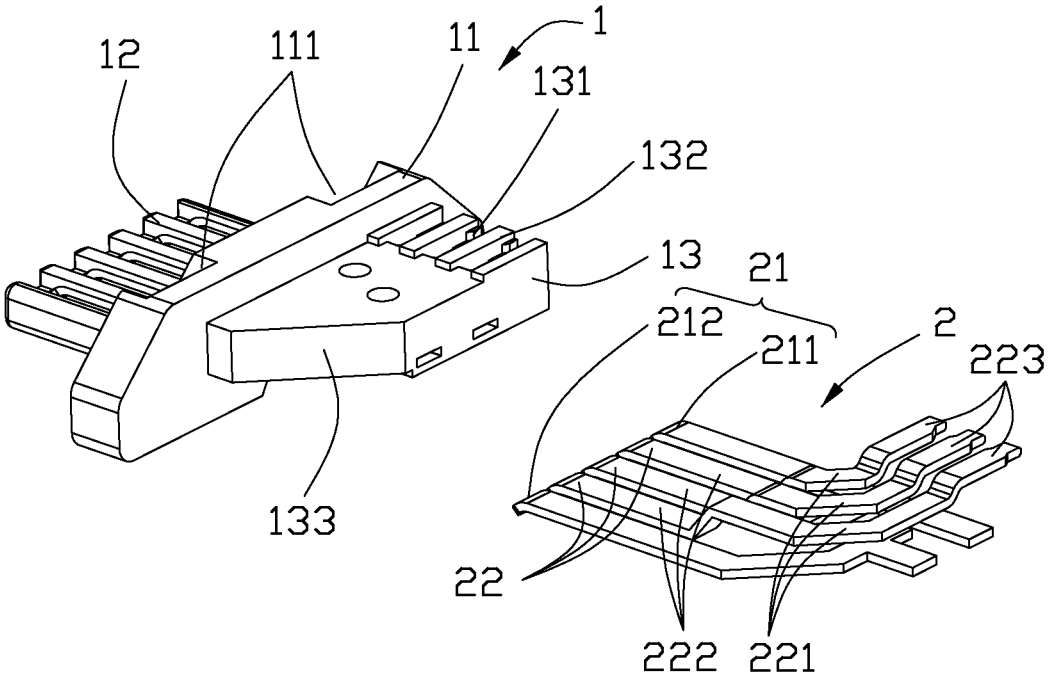
FIG. 6 is a perspective, exploded view of an insulative housing and a plurality of contacts.
Figure 7:
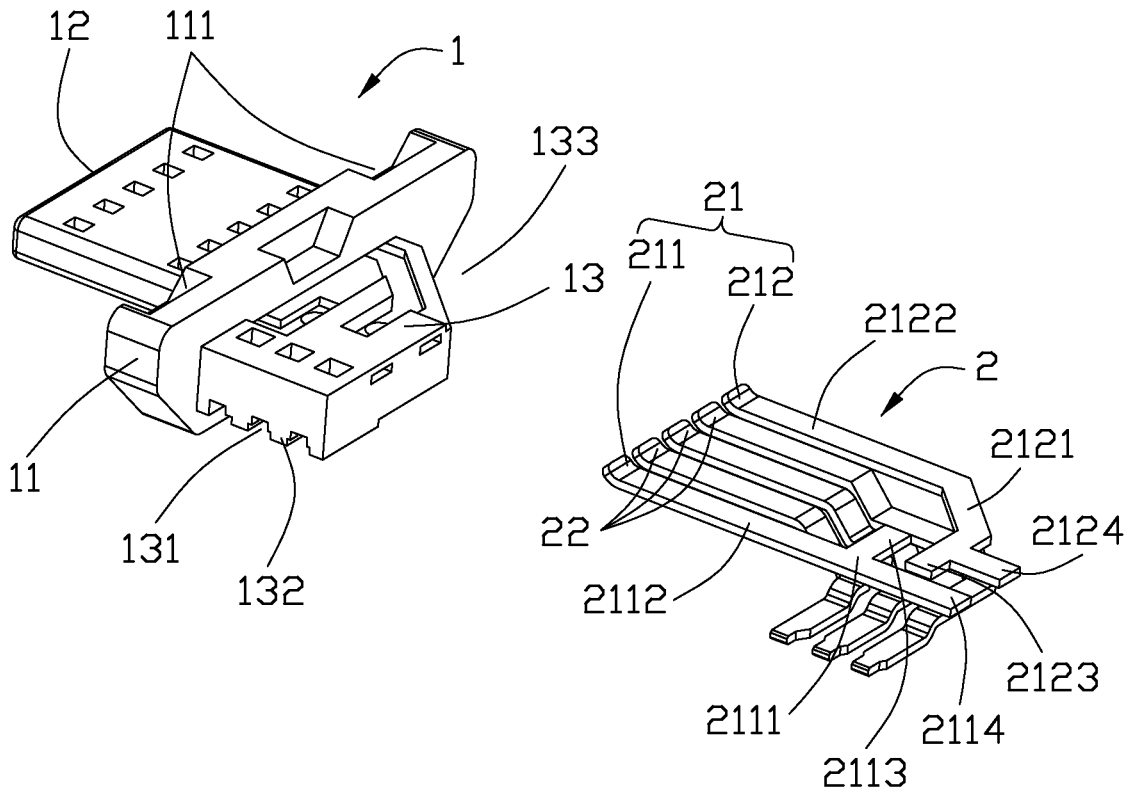
FIG. 7 is similar to FIG. 6, but taken from a different view.
Figure 8:
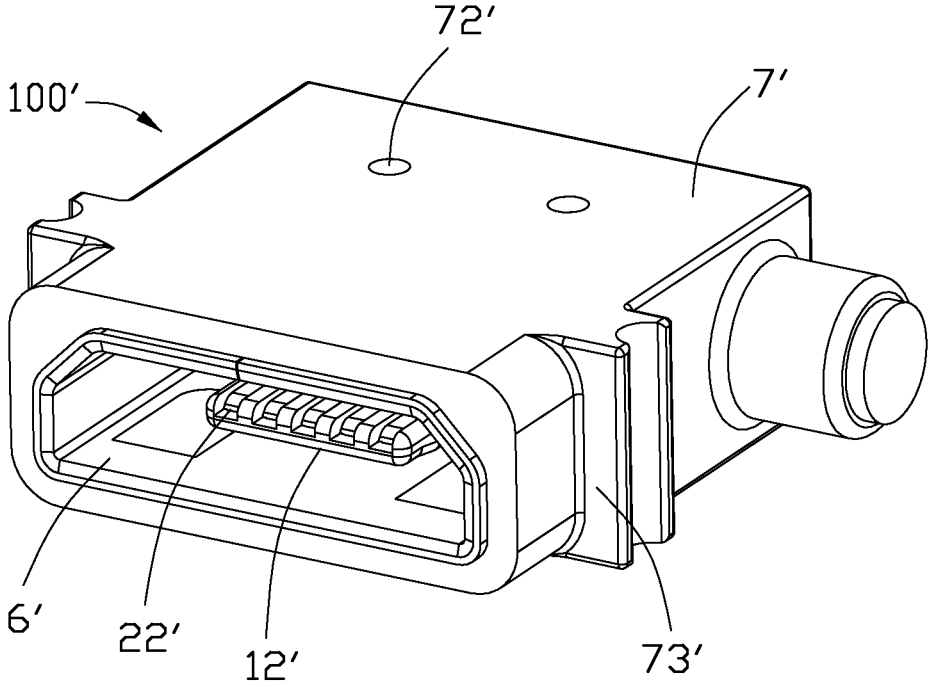
FIG. 8 is a perspective, assembled view of a receptacle connector in a second embodiment constructed in accordance with the present invention.
Figure 9:
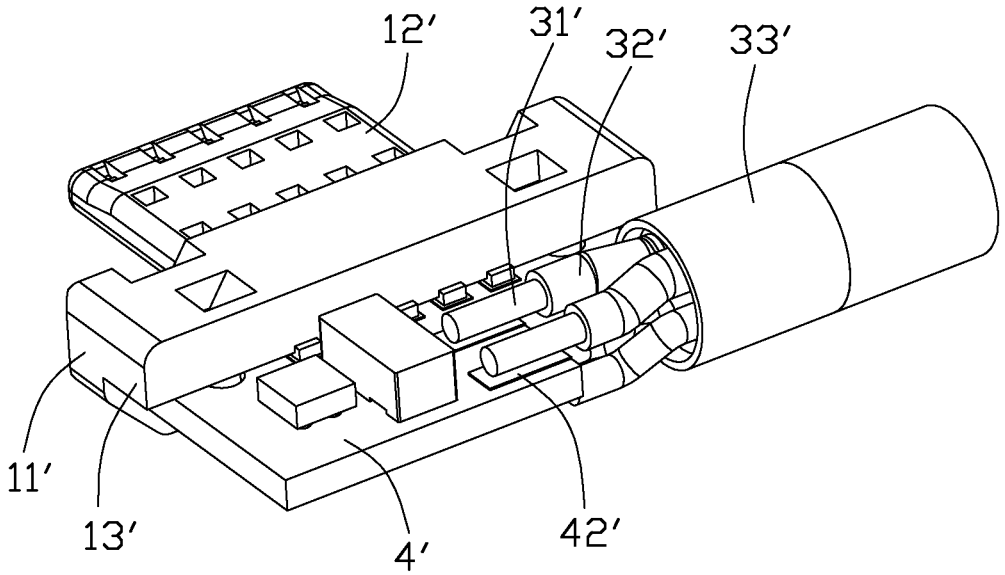
FIG. 9 is a perspective, partly assembled view of an insulative housing, a printed circuit board, and a cable of the receptacle connector.
Figure 10:
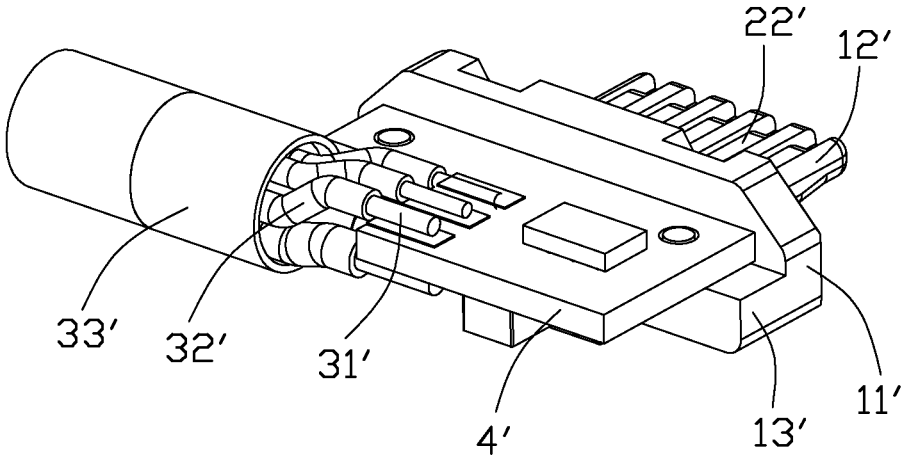
FIG. 10 is similar to FIG. 9, but taken from a different view.
Figure 11:
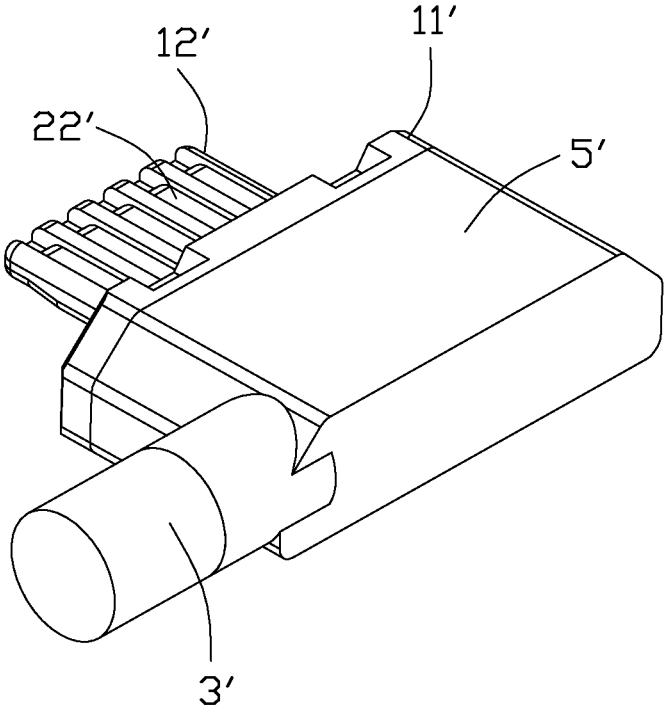
FIG. 11 is a perspective, partly assembled view of a glue block attached to an association of FIG. 2.
Figure 12:
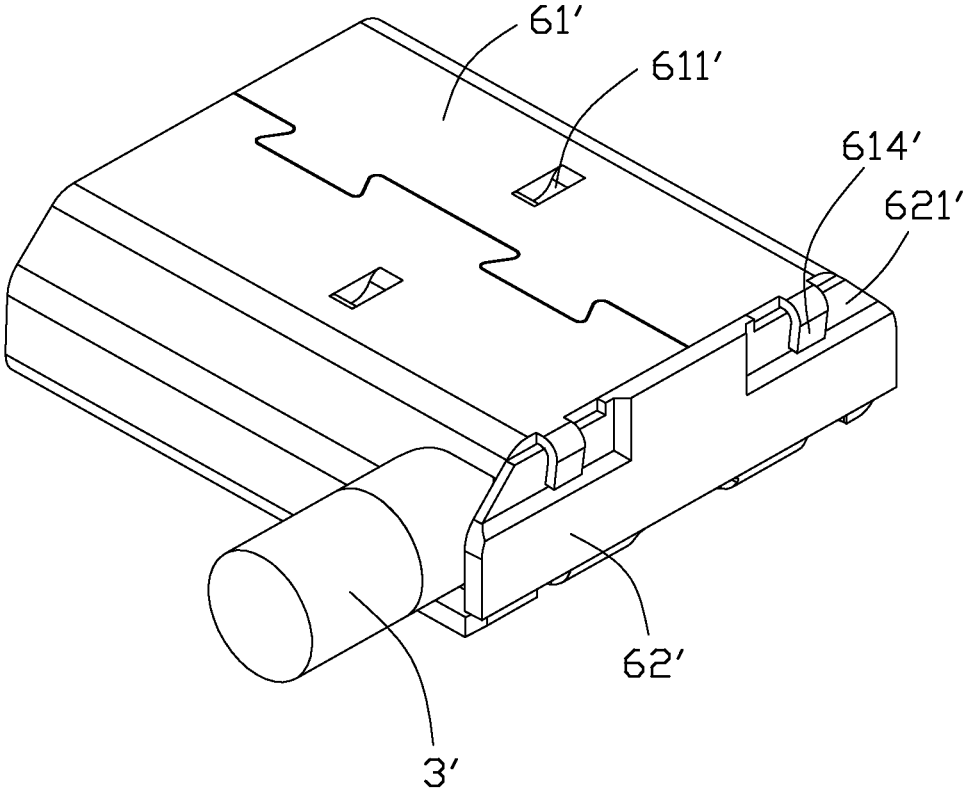
FIG. 12 is a perspective, partly assembled view of a metal shield attached to an association of FIG. 11.

Referring to FIGS. 6 and 7, the insulative housing 1 comprises a base portion 11, a tongue portion 12 extending forwardly from the base portion 11, and a rear plate 13 extending rearwardly from the base portion 11. The base portion 11 defines a plurality of cutouts 111 from an upper face and a lower face thereof. The tongue portion 12 defines a plurality of first passageways 121 extending along an insertion direction. The rear plate 13 has a plurality of second passageways 131 defined between each two adjacent ribs 132. The second passageways 131 extend along a transverse direction perpendicular to the insertion direction. The first passageways 121 are defined only on the lower face of the tongue portion 12. The second passageways 131 are defined on both the upper face and the lower face of the rear plate 13. The first passageways 121 and the second passageways 131 are communicated with each other through the base portion 11. The insluative housing 1 defines a cut portion 133 beside a corner of the rear plate 13 for giving place for the cable 3.

Referring to FIGS. 6 and 7, the contacts 2 are insert-molded in the insulative housing 1. The contacts 2 are divided into a plurality of first contacts 21 and a plurality of second contacts 22 according to respective different figures. The first contacts 21 are entirely positioned in a same horizontal plane. The second contacts 22 are positioned in different horizontal planes. Each contact 2 comprises a retaining portion, a contacting portion extending forwardly from the retaining portion, and a soldering portion extending perpendicular to the first contacting portion.

Referring to FIG. 7, the first contacts 21 comprise a left contact 211 and a right contact 212 approaching to the left contact 211 along an ejection direction opposite to the insertion direction. A first retaining portion 2111 of the left contact 211 extends straightly rearwardly from its first contacting portion 2112 and its first soldering portion 2113 extends perpendicular to its first contacting portion 2112 towards the right contact 212. A second retaining portion 2121 of the right contact 212 extends curvedly rearwardly from its second contacting portion 2122 and its second soldering portion 2123 extends perpendicular to its second contacting portion 2122 towards the left contact 211. The first soldering portion 2113 and the second soldering portion 2123 are offset positioned along the transverse direction. The first soldering portion 2113 is spaced away from the second soldering portion 2123 for a small distance along the insertion direction. The left contact 211 further comprises an extension portion 2114 extending straightly, rearwardly from the first retaining portion 2111. The right contact 212 further comprises a tail portion 2124 extending perpendicularly, rearwardly from the second soldering portion 2123. Therefore, the extension portion 2114 and the tail portion 2124 both extend along the insertion direction and space away from each other for a small distance along the transverse direction. The extension portion 2114 and the tail portion 2124 are both retained in the insulative housing 1 for reinforcing stability of the contacts 2.

Referring to FIG. 6, the second contacts 22 comprise a plurality of third contacting portions 222 positioned between the first contacting portion 2112 and the second contacting portion 2122. The third contacting portions 222 are positioned in the first horizontal plane, too. The third contacting portions 222 extend along the insertion direction. The third contacting portions 222 have same length. The second contacts 22 comprise a plurality of third soldering portions 223 extending beside the first, second soldering portions 2113, 2123. The third soldering portions 223 are positioned in a second horizontal plane higher than the first horizontal plane. The third soldering portions 223 extend along the transverse direction. The third soldering portions 223 have same length, too. The second contacts 22 further comprise a plurality of third retaining portions 221 curvedly connecting between the third contacting portions 222 and the third soldering portions 223. The third retaining portions 221 are positioned in a third horizontal plane higher than the first horizontal plane but lower than the second horizontal plane. The third retaining portion 221 in an outer circle is larger than that in an inner circle. In another saying, the third retaining portions 221 have different lengths.

Figure 4:
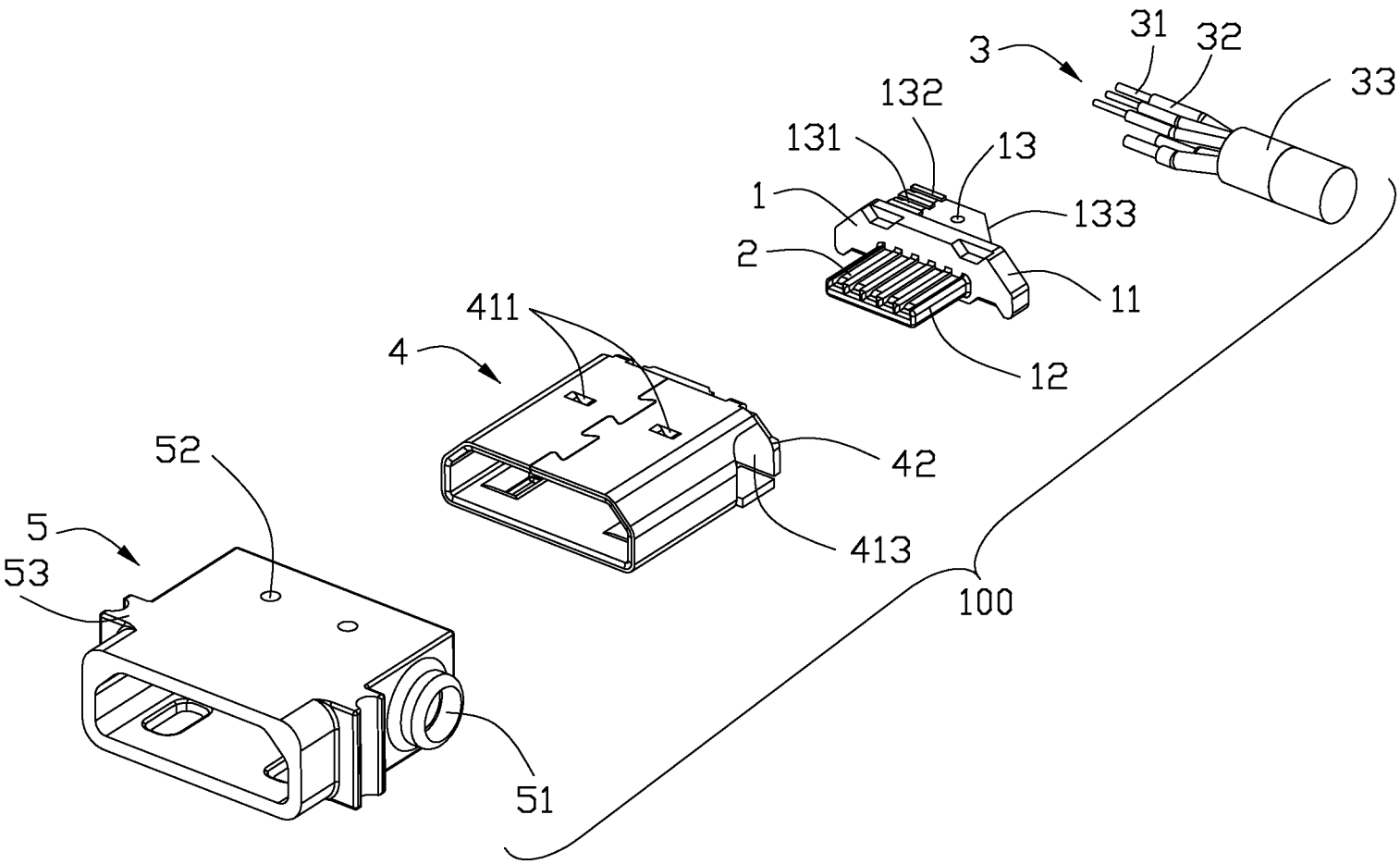
FIG. 4 is a perspective, fully exploded view of the receptacle connector.
Figure 5:
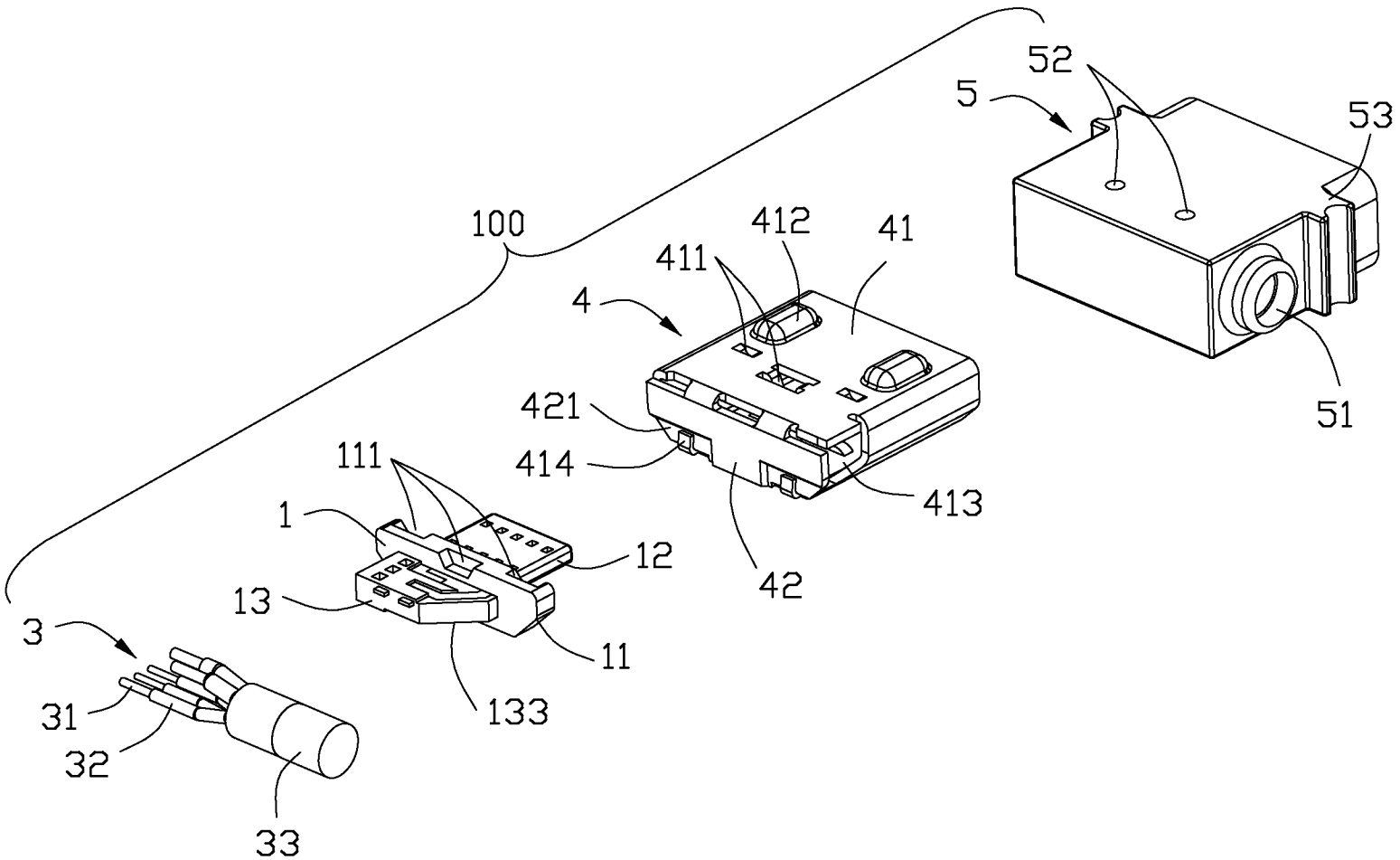
FIG. 5 is similar to FIG. 4, but taken from a different view.

Referring to FIGS. 4 and 5, the cable 3 comprises a plurality of wires 31, a plurality of insulative layers 32 each correspondingly and partly covering the wires 31, and a sheath 33 wrapping both the wires 31 and the corresponding insulative layers 32. The cable 3 is used for connecting to a mother board of an electronic appliance.

Referring to FIGS. 6 and 7, the metal shield 4 comprises a case portion 41 and a sheath portion 42 connecting to the case portion 41. The case portion 41 forms a plurality of protrusions 411 received in the cutouts 111 of the insulative housing so as to secure the metal shield 4 and the insulative housing 1. The case portion 41 defines a plurality of recesses 412 on an upper surface thereof for engaging with the plug connector when the plug connector is mated with the receptacle connector. The recesses 412 are not pierced through the metal shield 6 for facilitating over-molding of the insulative cover 5. The case portion 41 defines an opening 413 at a lateral side thereof for the cable 3 extending therethrough. The sheath portion 42 is integrally connected to a top surface of the metal shield 4 and bended towards a lower surface of the metal shield 4. The sheath portion 42 has a thinner portion 421 at a lower end thereof and the lower surface of the metal shield 4 forms a plurality of hooks 414 secured with the thinner portion 421.

Referring to FIGS. 6 and 7, the insulative cover 5 is molded over the metal shield 4 for waterproof purpose. The insulative cover 5 defines an aperture 51 corresponding to the opening 413 for the cable 3 extending therethrough. The insulative cover 5 defines a plurality of notches 52 on both its upper wall and lower wall formed by extracting tools which support and orient the receptacle connector 100 in assembling process. After assembling, the notches 52 are filled in glue material so as to prevent water from entering into the interior of the receptacle connector 100. The insulative cover 5 comprises a pair of mounting ears 53 at two lateral sides thereof for mounting the insulative cover 5 on the electronic appliance.

The contacts 2 of the receptacle connector 100 in the first embodiment of the present invention are not directly soldered on the mother board of the electronic appliance but alternatively soldered with one end of the cable 3 and another one end of the cable 3 is soldered on the mother board. Therefore, the receptacle connector 100 is flexibly soldered on the mother board of the electronic appliance because the printed circuit board 4 and the cable 3 are electrically connected between the contacts 2 and a mother board of the electronic appliance. The receptacle connector 100 is adjustable with respect to the mother board of the electronic appliance because the cable 3 has a length to adapt the adjustment.

Referring to FIGS. 8-14, a receptacle connector 100' in a second embodiment of the present invention used for receiving a mating plug connector (not shown) along an insertion direction, comprises an insulative housing 1', a plurality of contacts 2' retained in the insulative housing 1', a cable 3', a printed circuit board 4' connecting between the contacts 2' and the cable 3', a glue block 5' molded over the printed circuit board 4', a metal shield 6' covering the insulative housing 1' and the glue block 5', and an insulative cover 7' molded over the metal shield 6'.

Figure 13:
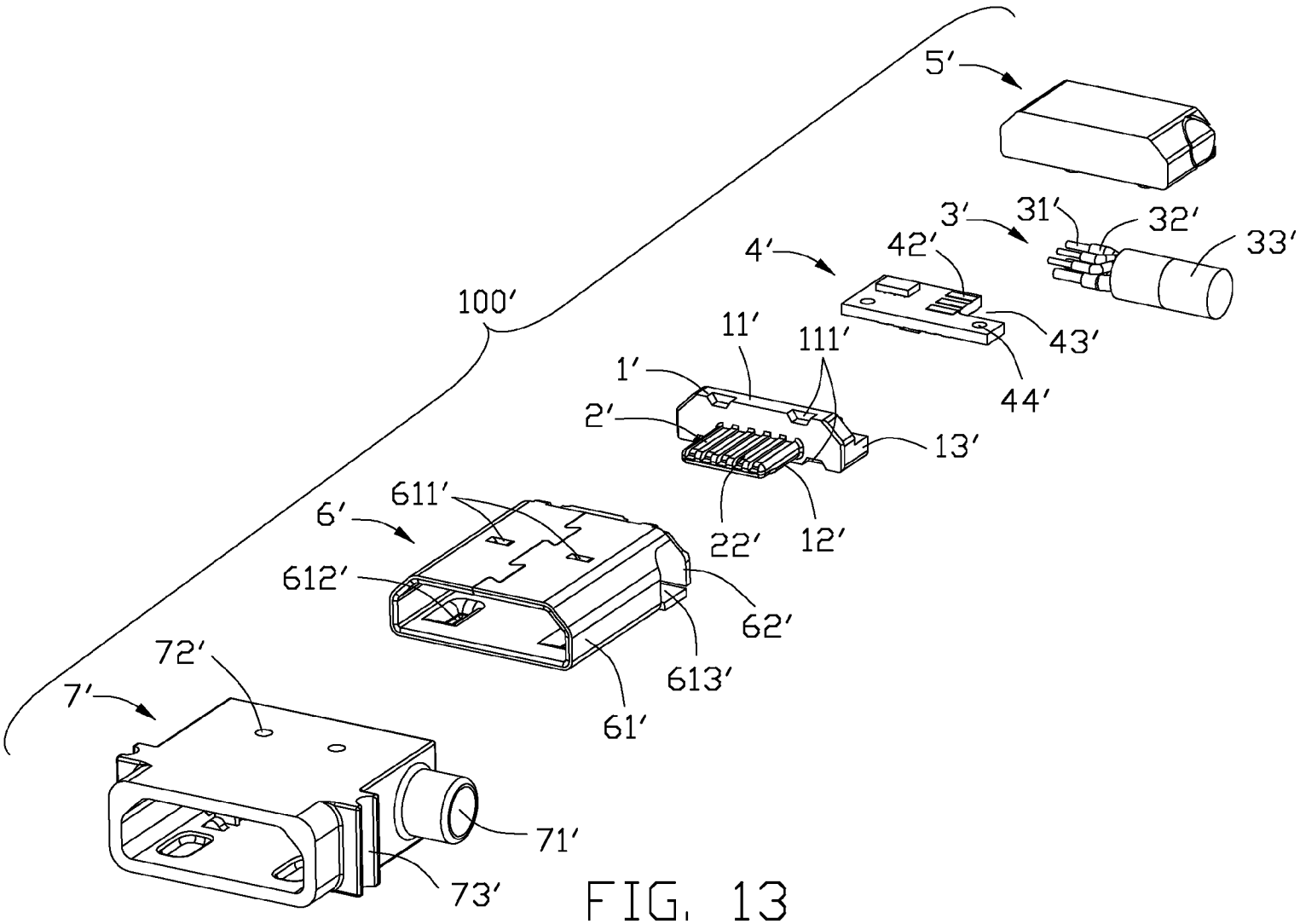
FIG. 13 is a perspective, fully exploded view of the receptacle connector.
Figure 14:
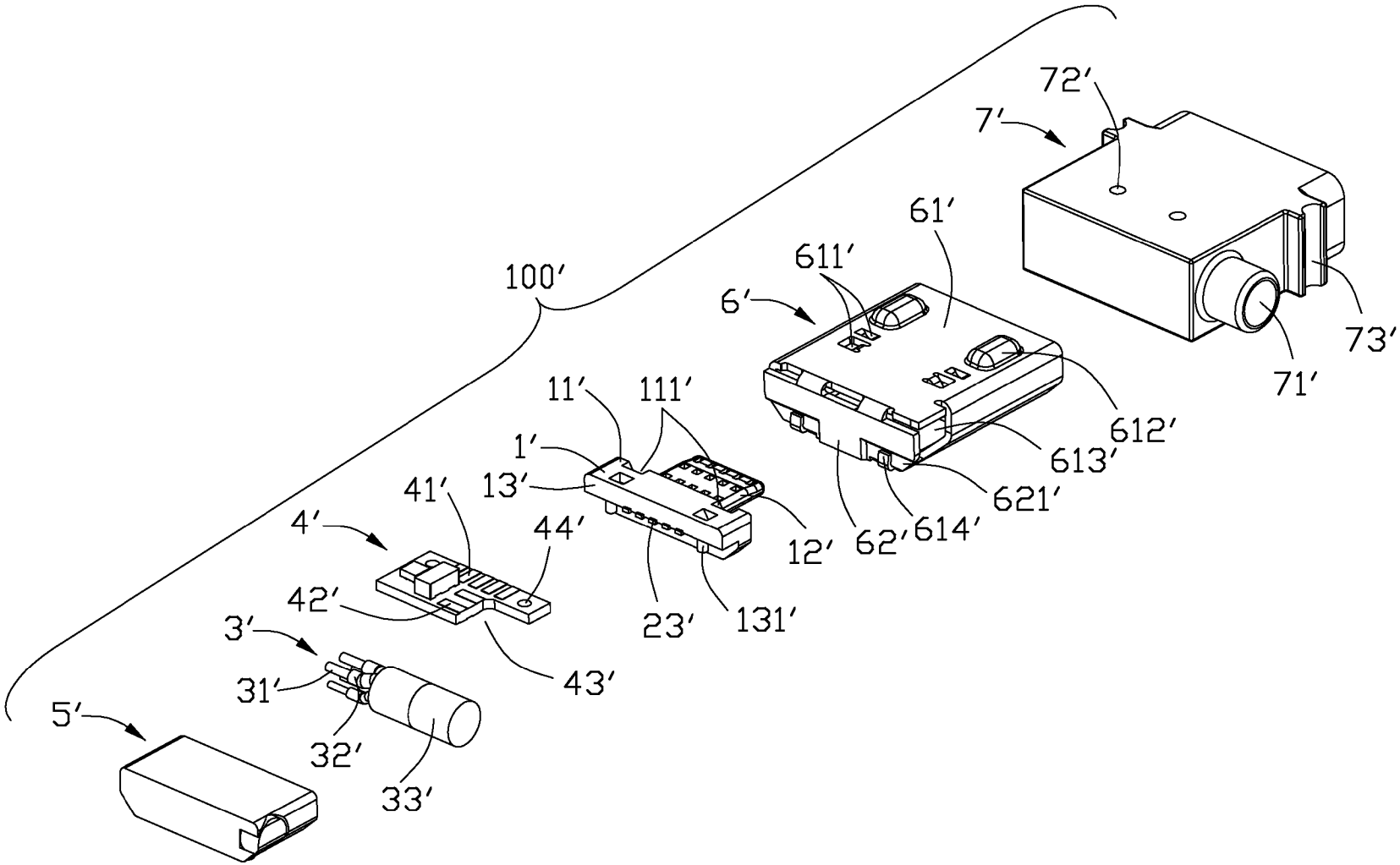
FIG. 14 is similar to FIG. 13, but taken from a different view.

Referring to FIGS. 13 and 14, the insulative housing 1' comprises a base portion 11', a tongue portion 12' extending forwardly from the base portion 11', and a rear plate 13' extending rearwardly from and lower than the base portion 11'. The base portion 11' defines a plurality of cutouts 111' from an upper face and a lower face thereof. The rear plate 13' has a pair of posts 131' extending upwardly to be substantially planar with the upper face of the base portion 11'.

Referring to FIGS. 13 and 14, the contacts 2' are insert-molded in the insulative housing 1'. The contacts 2' comprise a plurality of retaining portions (not shown) retained in the base portion 11' of the insulative housing 1', a plurality of contacting portions 22' extending forwardly from the retaining portions and beyond the tongue portion 12', and a plurality of rear portions 23' extending rearwardly from the retaining portion and supported by the rear plate 13'.

Referring to FIGS. 13 and 14, the cable 3' comprises a plurality of wires 31', a plurality of insulative layers 32' each correspondingly and partly covering the wires 31', and a sheath 33' wrapping both the wires 31' and the corresponding insulative layers 32'. The cable 3' is used for connecting to a mother board of an electronic appliance.

Referring to FIGS. 8-14, the printed circuit board 4' comprises a plurality of first conductive pads 41' connecting with the rear portions 23' of the contacts 2' and a plurality of second conductive pads 42' connecting with the wires 31' of the cable 3'. The first conductive pads 41' and the second conductive pads 42' are electrically connected with each other via circuits on the printed circuit board 4'. The first conductive pads 41' are arranged in a row and on an upper face of the printed circuit board 4'. The second conductive pads 42' are positioned on two opposite faces of the printed circuit board 4', having an upper row on the upper face of the printed circuit board 4' as same to the first conductive pads 41' and a lower row on the lower face of the printed circuit board 4' opposite to the first conductive pads 41'. The second conductive pads 42' have a large gap between each two adjacent conductive pads and therefore, the second conductive pads 42' facilitate soldering with the wires 31' of the cable 3'. The first conductive pads 41' and the second conductive pads 42' extend perpendicular to each other, i.e., the first conductive pads 41' extend along the insertion direction while the second conductive pads 42' extend along a transverse direction perpendicular to the insertion direction. Therefore, the receptacle connector 100' has a reduced diameter in the insertion direction. The printed circuit board 4' defines a cut portion 43' both beside the second conductive pads 42' along the insertion direction and beside the first conductive pads 41' along the transverse direction. The cut portion 43' is used for giving place for the cable 3'. The printed circuit board 4' defines a plurality of holes 44' receiving the posts 131' for securing the printed circuit board 4' on the insulative housing 1'.

Referring to FIGS. 13 and 14, the glue block 5' is formed by coating with glue material for firmly attaching the printed circuit board 4' on the insulative housing 1'.

Referring to FIGS. 13 and 14, the metal shield 6' comprises a case portion 61' and a sheath portion 62' connecting to the case portion 61'. The case portion 61' forms a plurality of protrusions 611' received in the cutouts 111' of the insulative housing 1' so as to secure the metal shield 6' and the insulative housing 1'. The case portion 61' defines a plurality of recesses 611' on an upper surface thereof for engaging with the plug connector when the plug connector is mated with the receptacle connector. The recesses 611' are not pierced through the metal shield 6' for facilitating over-molding of the insulative cover 7'. The case portion 61' defines an opening 613' at a lateral side thereof for the cable 3' extending therethrough. The sheath portion 62' is integrally connected to a top surface of the metal shield 6' and bended towards a lower surface of the metal shield 6'. The sheath portion 62' has a thinner portion 621' at a lower end thereof and the lower surface of the metal shield 6' forms a plurality of hooks 614' secured with the thinner portion 621'.

Referring to FIGS. 13 and 14, the insulative cover 7' is molded over the metal shield 6' for waterproof purpose. The insulative cover 7' defines an aperture 71' corresponding to the opening 613' for the cable 3' extending therethrough. The insulative cover 7' defines a plurality of notches 72' on both its upper wall and lower wall formed by extracting tools which support and orient the receptacle connector 100' in assembling process. After assembling, the notches 72' are filled in glue material so as to prevent water from entering into the interior of the receptacle connector 100'. The insulative cover 7' comprises a pair of mounting ears 73' at two lateral sides thereof for mounting the insulative cover 7' on the electronic appliance.

The contacts 2' of the receptacle connector 100' in the second embodiment of the present invention are not directly soldered on the mother board of the electronic appliance. Therefore, the receptacle connector 100' is flexibly soldered on the mother board of the electronic appliance because the printed circuit board 4' and the cable 3' are electrically connected between the contacts 2' and a mother board of the electronic appliance. The receptacle connector 100' is adjustable with respect to the mother board of the electronic appliance because the cable 3' has a length to adapt the adjustment. Except first and second conductive pads 41', 42', the printed circuit board 4' has large space for positioning other electrical modules, such as an EMI (Electro Magnetic Interference) module, an ESD (Electro-Static discharge) module, etc. Therefore, the printed circuit board 4' is variable in its layout.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A receptacle connector comprising:

an insulative housing defining a front horizontal mating plate and a rear horizontal connecting plate in a front-to-back direction;

a plurality of contacts disposed in the housing, each of said contacts including a horizontal front contacting section extending along said front-to-back direction and exposed upon the front mating plate, a horizontal middle angled section respectively connected to the front contacting section and a horizontal rear connecting section which lies upon the rear horizontal connecting plate and extends in a first transverse direction perpendicular to said front-to-back direction; and a cable including a plurality of wires mechanically and electrically connected to the corresponding rear connecting sections, respectively, and extending in a second transverse direction opposite to the first transverse direction.

2. The receptacle connector as claimed in claim 1, wherein the contacts are divided into two groups, the front mating sections of the contacts in the first group and those in the second group are located in a same horizontal surface of the front mating plate while the rear connecting sections of the contacts in the first group and those in the second group are located at opposite surfaces of the rear connecting plate.

3. The receptacle connector as claimed in claim 1, wherein the rear connecting sections of the contacts in the first group are offset away from those in the second group in the first transverse direction.

4. The receptacle connector as claimed in claim 3, wherein each of the contacts in the second group further includes an extension behind the corresponding connecting section along the front-to-back direction for supporting the corresponding contact in the rear connecting plate.

5. A receptacle connector comprising:

an insulative housing defining a front horizontal mating plate and a rear horizontal connecting plate in a front-to-back direction;

a plurality of first contacts disposed in the housing, each of said first contacts including a horizontal front contacting section extending along said front-to-back direction and exposed upon the front mating plate, and a horizontal rear connecting section which lies and is exposed upon the rear horizontal connecting plate and extends in a transverse direction perpendicular to said front-to-back direction, and an extension portion extending rearwardly from a position of said rear connecting section in said front-to-back direction; and a cable including a plurality of wires mechanically and electrically connected to the rear connecting sections of the corresponding first contacts, respectively; wherein the extension portion is protectively embedded within the rear horizontal connecting plate except a rear end being rearwardly exposed to an exterior.

6. The receptacle connector as claimed in claim 5, wherein the extension portion of one of said first contacts is aligned with the corresponding contacting section in the front-to-back direction, and the extension portion of another of said first contacts is offset from the corresponding contacting section in the transverse direction.

7. The receptacle connector as claimed in claim 5, wherein all said first contacts are commonly located in a same horizontal plane.

8. The receptacle connector as claimed in claim 7, wherein an amount of all said first contacts is two.

9. The receptacle connector as claimed in claim 8, further including a plurality of second contacts commonly located between said two of said first contacts in the transverse direction; wherein each of said second contacts includes a front contacting portion located in said horizontal plane, and a rear connecting portion located in another horizontal plane offset from said same horizontal plane in a vertical direction perpendicular to both said front-to-back direction and said transverse direction.

10. A receptacle connector comprising:

an insulative housing defining a front horizontal mating plate and a rear horizontal connecting plate in a front-to-back direction;

a group of contacts disposed in the housing, each of said contacts including a horizontal front contacting portion extending along said front-to-back direction and exposed upon the front mating plate, and a horizontal rear soldering portion which lies and is exposed upon the rear horizontal connecting plate and extends in a transverse direction perpendicular to said front-to-back direction, and a retaining portion located between the front contacting portion and the rear soldering portion; and a cable including a plurality of wires mechanically and electrically connected to the rear soldering portions of the corresponding contacts, respectively; wherein the front contacting portion is located in a first horizontal plane, the rear soldering portion is located in a second horizontal plane, and the retaining portion is located in a third plane vertically between the first horizontal plane and the second horizontal plane in a vertical direction perpendicular to both said front-to-back direction and said transverse direction.

11. The receptacle connector as claimed in claim 10, further including another group of contacts all located in the first plane.

12. The receptacle connector as claimed in claim 11, wherein an amount of said another group of contacts is two, and all said contacts are located between the two contacts in said another group along the transverse direction.

13. The receptacle connector as claimed in claim 12, wherein the soldering portions of all said contacts extend beyond one of said two contacts in said another group in said transverse direction, so that the soldering portions of said contacts and the contacting portions of said contacts are respectively located by two sides of said one of the two contacts in said another group in said transverse direction in a top view.

14. The receptacle connector as claimed in claim 13, wherein the other of said two contacts in said another group has a corresponding soldering portion extending toward said one of said two contacts in said another group.

15. The receptacle connector as claimed in claim 10, wherein the retaining portions are protectively embedded within the rear horizontal connecting plate while the contacting portions and the soldering portions are exposed to an exterior.

* * * * *